US006336636B1

(12) United States Patent
Smart

(10) Patent No.: US 6,336,636 B1
(45) Date of Patent: Jan. 8, 2002

(54) METHOD OF EXTENDING PLAYING TIME IN A COIN-OPERATED CRANE GAME

(75) Inventor: Jeffrey T. Smart, Altoona, IA (US)

(73) Assignee: Smart Industries Corporation, Des Moines, IA (US)

( * ) Notice: Subject to any disclaimer, the term of this patent is extended or adjusted under 35 U.S.C. 154(b) by 0 days.

(21) Appl. No.: 09/534,823

(22) Filed: Mar. 23, 2000

Related U.S. Application Data

(60) Provisional application No. 60/125,893, filed on Mar. 24, 1999.

(51) Int. Cl.[7] ..... A63B 67/00
(52) U.S. Cl. ..... 273/447; 463/7
(58) Field of Search ..... 463/7, 16, 25; 273/447, 448, 138.1, 440, 454, 459, 460, 142 R, 142 H

(56) References Cited

U.S. PATENT DOCUMENTS

| | | | | |
|---|---|---|---|---|
| 4,008,792 A | | 2/1977 | Levasseur et al. | |
| 4,718,667 A | | 1/1988 | Shoemaker, Jr. | |
| 5,371,681 A | | 12/1994 | Juds et al. | |
| 5,397,134 A | * | 3/1995 | Fishman et al. | 273/448 |
| 5,415,417 A | * | 5/1995 | Reis, Jr. | 273/447 |
| 5,589,812 A | | 12/1996 | Jones | |
| 5,678,823 A | * | 10/1997 | Chaffee et al. | 273/448 |
| 5,697,611 A | | 12/1997 | Kelly et al. | |
| 5,711,530 A | * | 1/1998 | Lewis | 273/448 |
| 5,743,523 A | | 4/1998 | Kelly et al. | |
| 5,855,374 A | | 1/1999 | Shoemaker, Jr. | |
| 5,860,649 A | | 1/1999 | Buchholz | |
| 5,876,284 A | | 3/1999 | Acres et al. | |
| 5,967,892 A | * | 10/1999 | Shoemaker, Jr. | 463/7 |

* cited by examiner

*Primary Examiner*—Michael O'Neill
(74) *Attorney, Agent, or Firm*—Zarley, McKee, Thomte, Voorhees & Sease, P.L.C.

(57) ABSTRACT

A method of extending playing time and prize winning opportunities in a crane game includes the steps of checking for additional coins at any point during the playing time and recalculating the allotted playing time accordingly. An alarm signal can be provided when the allotted time is about to expire. The method can also allow the player to continue playing and winning multiple prizes so long as the allotted time has not expired.

8 Claims, 4 Drawing Sheets

Microfiche Appendix Included
(2 Microfiche, 62 Pages)

METHOD OF EXTENDING PLAYING TIME IN A COIN-OPERATED CRANE GAME

CROSS REFERENCE TO RELATED APPLICATIONS

This application claims the priority of U.S. Provisional Application Ser. No. 60/125,893 filed Mar. 24, 1999.

REFERENCE TO A MICROFICHE APPENDIX

This disclosure includes references to a microfiche appendix containing a computer program code listing collectively called Appendix A. Microfiche Appendix A includes a total of 62 frames on 2 microfiche sheets.

A portion of the disclosure of this patent document contains material which is subject to copyright protection. The copyright owner has no objection to the facsimile reproduction by anyone of the patent document or the patent disclosure, as it appears in the patent and trademark office patent files or records, but otherwise reserves all copyrights whatsoever.

BACKGROUND OF THE INVENTION

The present invention relates to the field of coin-operated arcade games. More particularly, this invention relates to a coin-operated arcade game commonly referred to as a "crane game." The invention relates to a method of allowing the player to purchase additional playing time to extend the game play in a given round, and could be applicable to other types of coin-operated games.

Crane games themselves are not new. For instance, U.S Pat. No. 4,718,667 discloses a basic X-Y movement crane game. That disclosure is incorporated by reference herein. However, various methods of controlling the duration and possible outcomes of the game exist.

In one of the conventional methods, the player deposits a given amount of money, which when detected by the conventional mechanics, circuitry, and programming of the machine, provides for a predetermined fixed amount of playing time. During this time, the player typically uses a joystick to control the head of the crane and position it along X and Y axes over the prize sought. Then, the player pushes a button to drop the claw on the crane head down along the Z axis into the pile of prizes observable through the clear window at the front of the machine. When a claw reaches the bottom of its allowable Z movement or "stroke," the claw closes automatically and returns to its home position. If the player was lucky or skillful enough to grab a prize with the claws, the prize falls into a prize box where the player can reach it.

Normally, play is ended when either the time expires or the player successfully captures a prize, whichever occurs first. To continue play, the player must purchase a new game after the time has expired in the first game. Since the claw returns to the home position at the end of each game, the player loses valuable time repositioning the claw over the desired prize in the new game. Furthermore, the player can only win once in a given round. There is a need for a method of giving the player an opportunity for extending play and increasing the number of opportunities for winning prizes during a given round in a coin-operated crane game.

A primary objective of the present invention is the provision of a method for extending playing time in a coin-operated crane game.

Another objective of the present invention is the provision of a method of extending playing time which allows the player to buy additional playing time once a signal indicates that limited time is remaining in the present game.

Another objective of the present invention is the provision of a method of extending playing time which helps avoid unnecessary repositioning of the claw.

Another objective of the present invention is the provision of a method of extending playing time in a coin-operated crane game wherein the player can win as many prizes as time permits by inserting additional coins before the current period is over.

Another objective of the present invention is the provision of a method of extending playing time allowing the player to extend playing time at any time in a given round.

These and other objectives will be apparent from the drawings, as well as from the description and claims that follow.

SUMMARY OF THE INVENTION

The present invention relates to a method of extending game playing time in a coin-operated arcade game. The method includes the steps of checking for additional coins during playing time and recalculating the allotted playing time accordingly. An alert signal can be provided to the player when the allotted time is about to expire. The method can also include a "prize detection with time remaining" step that allows the player to continue playing and winning multiple prizes so long as time (original time plus "buy-in" time) has not expired.

DETAILED DESCRIPTION OF THE PREFERRED EMBODIMENT

Figure 1:
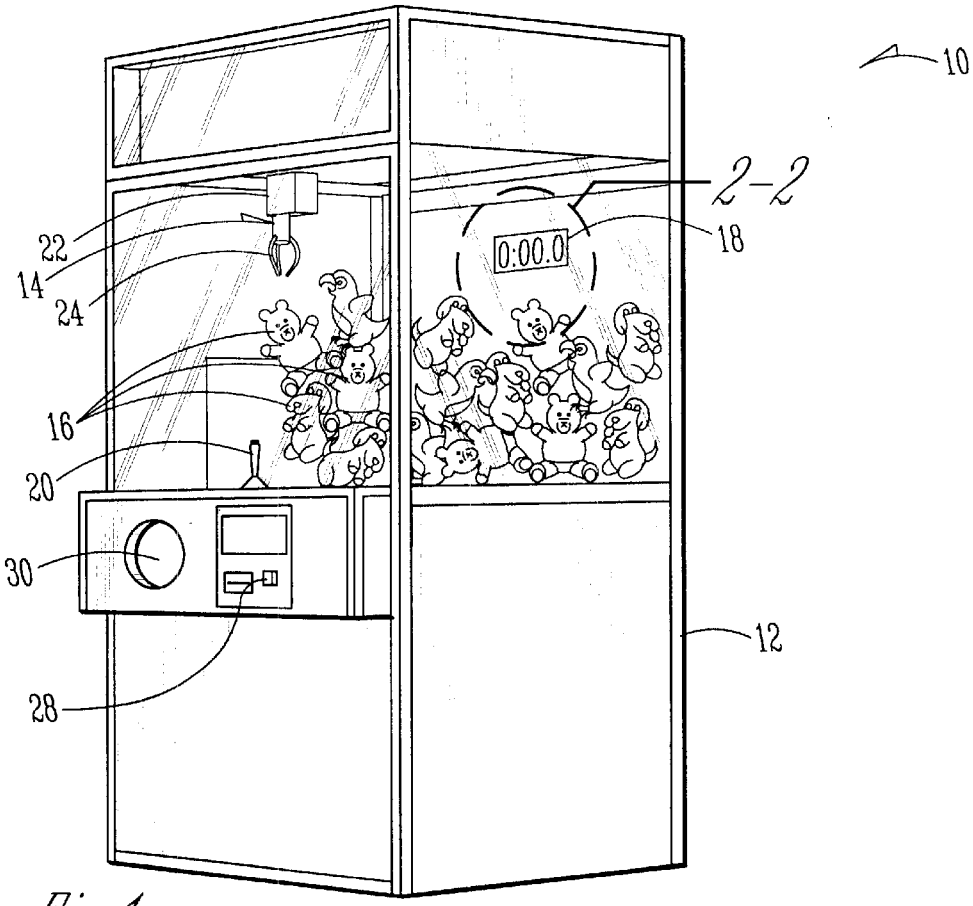
FIG. 1 is a perspective view of the claw-type crane game machine for carrying out the method of this invention.

The structure of the basic coin-operated crane game is well-known and is disclosed in U.S. Pat. Nos. 5,855,374 and 4,718,667. Those disclosures are incorporated by reference herein. The game 10 of this invention has a similar game cabinet 12 as shown in the FIGS. 1 and 2. A claw mechanism 14 is utilized instead of the vacuum device shown in U.S. Pat. No. 5,855,374.

Figure 3:
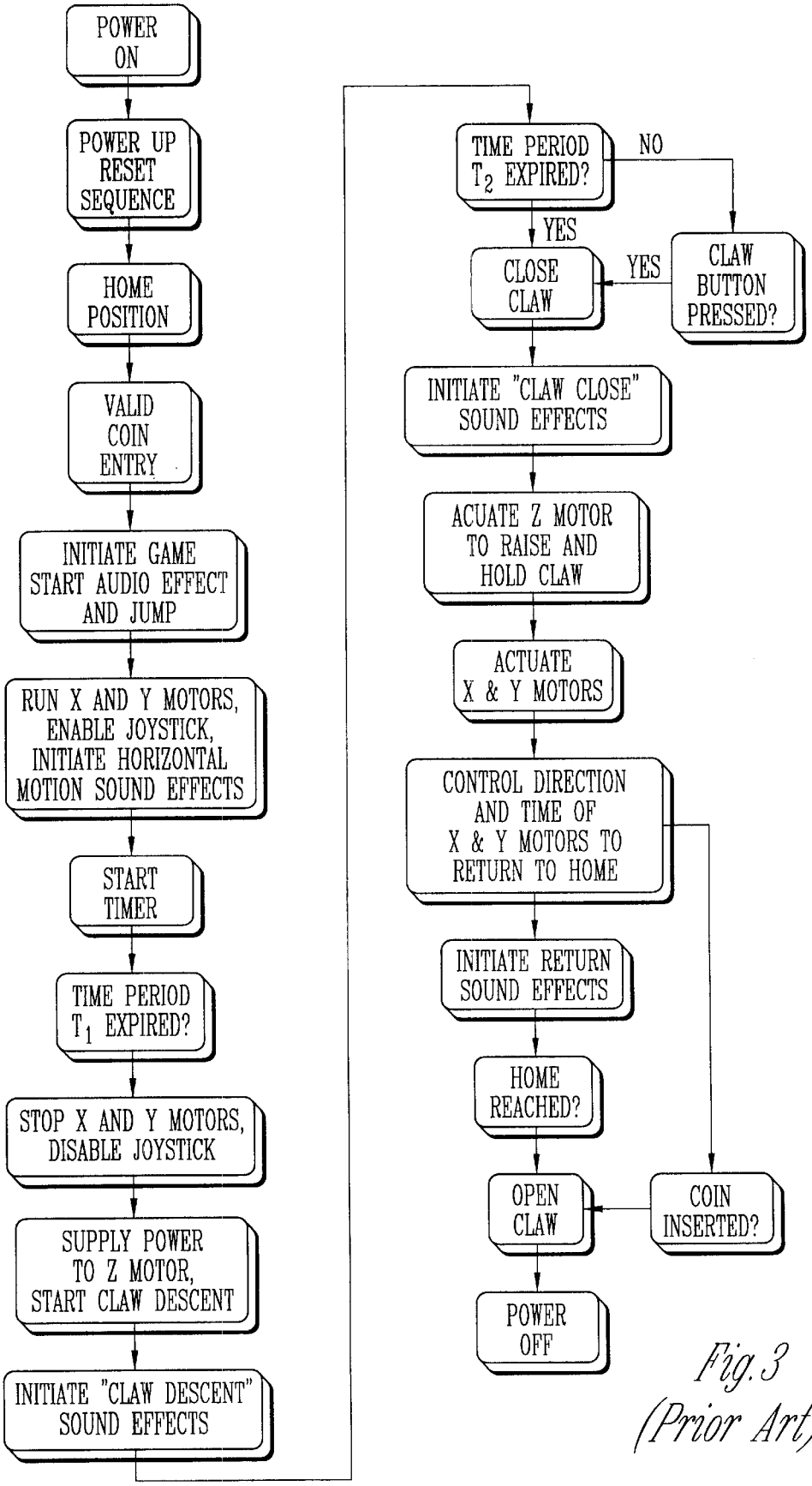
Fig. 3 (Prior Art)
FIG. 3 is a flow chart showing a prior art method of operating a crane game.

FIG. 3 is adapted from FIG. 8 of the U.S. Pat. No. 4,718,667 and shows a prior art method of operating the crane. Note that the player can only win one prize in this prior art device, no matter how many coins are inserted. The claw opens over the home position or prize compartment only once. The present invention provides improved means and methods for extending playing time in similar cranes and allows the player the opportunity to win multiple prizes without restarting the game.

General Description of Game

The method (referred to herein as Buy-In program) is based around the purchase of playing time—versus the purchasing of individual, separate games—and allows numerous attempts to win a prize 16 during the purchased time period—versus allowing one single attempt per game under the standard game plan.

Initial Time Purchasing

Purchasing initial game play time requires a specifiable amount of money. Once this initial monetary threshold has been reached, a specifiable amount of play time is given.

The number of coin inputs needed to purchase the initial amount of game time is set by the dual in-line package (DIP) switches, which include a bank of eight on/off switches.

Figure 2:
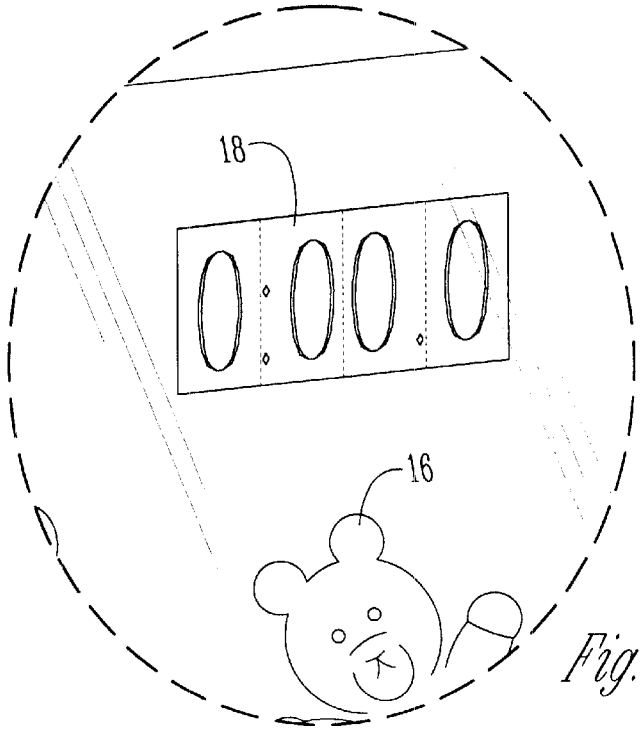
FIG. 2 is an enlarged frontal view of the area designated 2—2 in FIG. 1 showing the prize compartment, the crane head in the home position, and the digit readout.

The amount of initial game time given is set through the software setting setup. A four space digital readout (with seven segment LEDs at each space) allows the setup person to use the joystick 20 to select a non-play mode and program various game setting types (1–99 available) with desired values (1–99 available). One of these setting types corresponds to the initial game time. This initial game time can be set in one second increments from 10 to 59 seconds. In a play mode, the digital readout 18 displays the playing time remaining as seen in FIG. 2.

Purchasing of Added (Buy-In) Time

After the initial play time is purchased, additional coin inserts that occur prior to the conclusion of the present game give additional time for the present game.

Additional coin inputs will be used only for the present game play period.

Purchasing for a new play period is not allowed until the present play period expires.

The amount of additional time given for coin inserts after the purchase of initial game time is set through the software setting set up. This additional game time can be set in one second increments from 10 to 59 seconds.

Even after game play time expires, additional coin inserts will allow the purchasing of extra play time until the crane head 22 is fully "home" and the final prize detection period begins.

Play Operation of the Game

Crane play cycles proceed as in a standard game.

The player is allowed to move the crane head 22 about the playfield.

Once the claw 24 is dropped to the merchandise and the claw closes, the game program automatically takes over.

The now-closed claw is fully raised and the crane head 22 returns to the "Home" position over the prize box 26, releasing any merchandise that may have been held by the claw 24.

Sound Indicator to Signal that Play Time Will Soon Expire

When the available play time falls below 15 seconds, an indicator sound signals that the customer should add more coins to allow more play time.

Method for Ending a Game Play Round

A software setting (settable by the operator) allows a unique method of ending each game. The game ends only when all game time T purchased by the player expires. This setting allows multiple wins for any amount of purchased time.

Game Operation Once Play Time Expires

At the point of time expiration, the game program automatically drops—then closes the claw 24.

The software then automatically finishes the game play cycle as if the player had initiated the claw drop and close action.

Beginning of a New Game Time Purchasing Round

Once the time expires on the present game purchasing round, any money added to the game 10 will be used towards the next game time purchasing round.

Preferred Method & Best Mode

Figure 4:
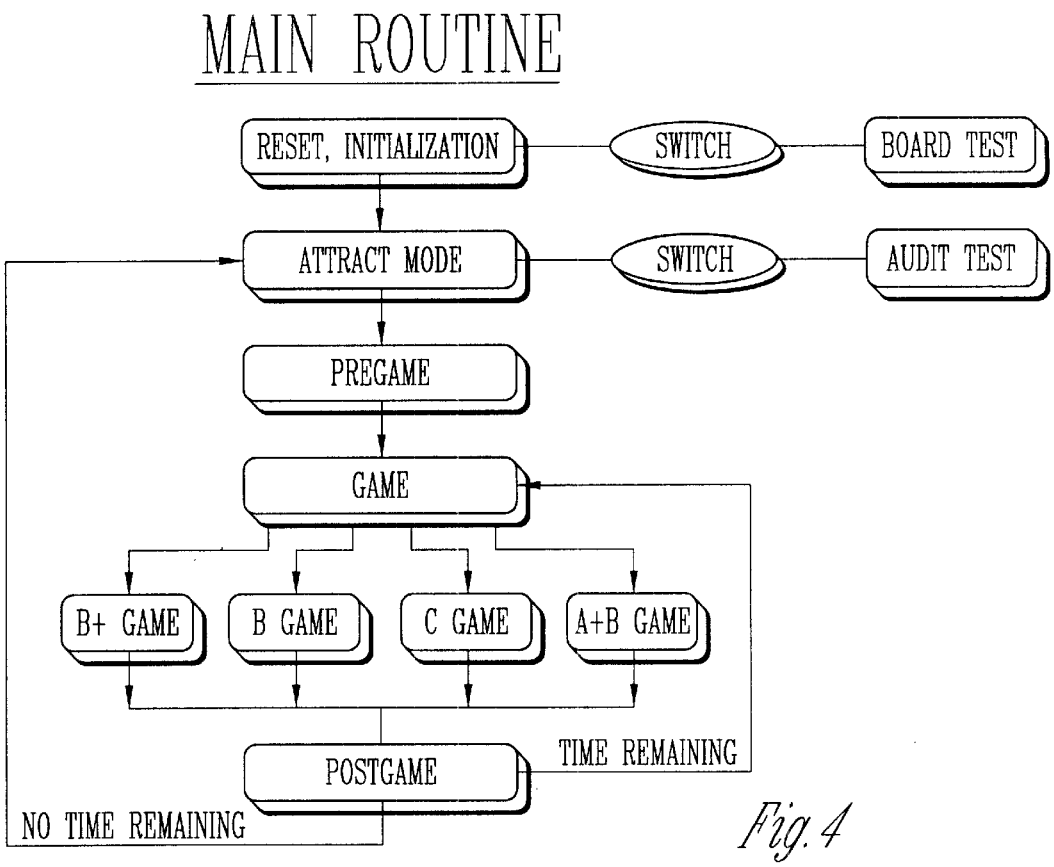
FIG. 4 is a block diagram flow chart of the method of this invention for extending game play time in the crane game of FIG. 1.
Figure 4A:
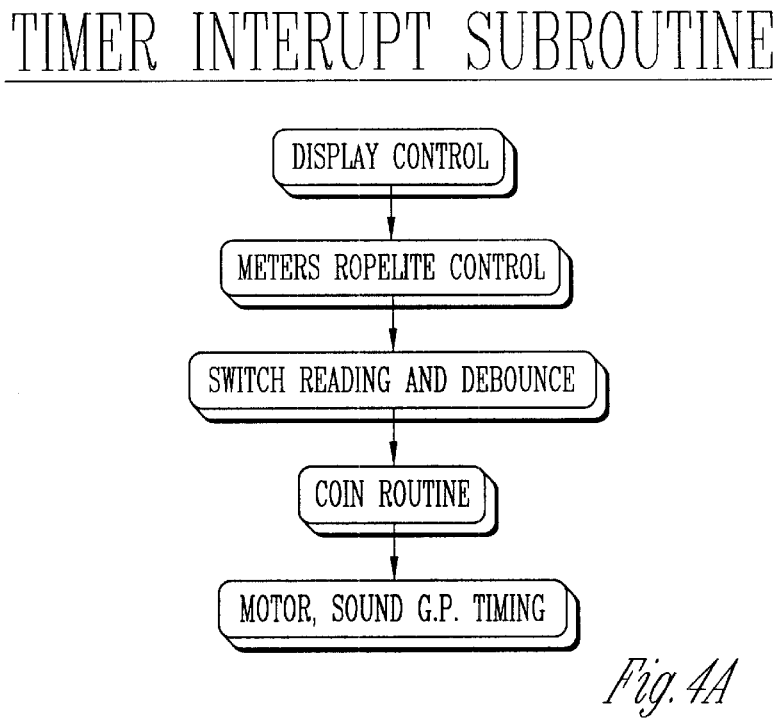
FIG. 4A is a block diagram depicting the timer interrupt subroutine for this invention.

FIG. 4 shows a flow chart depicting the unique features of this method. During reset/initialization, the variables for computer operation are initialized. If the test board switch is activated, the machine setup operator can test the machine in a stand alone manner.

The machine is normally powered up and in an "awaiting coin" or "attract" sequence. Lights and sounds are used to attract potential players. If the audit switch is activated, the operator can set the game parameters that are not covered by the DIP switches (i.e.—time for initial coins and time for additional coins).

The crane head starts in the home position. Once a valid coin entry is detected, the timer values T, TL, TW are set and/or calculated to the corresponding preselected number of seconds, according to the software setting set up initial values for these variables. The game starts and the joystick 20, the X and Y motors, and the claw drop button 28 are activated and put under player control. If the player inserts additional coins at this time, valid coin entries will again trigger the timer to add the appropriate number of seconds to extend or revise the playing time for the round.

As is known in the art, various variations of the game can be played using the same machine hardware. The game configuration is set by switches on the controller board of the machine. The game configurations include: A+B game, B game, B+ game and C game.

The A+B game setting may be used with either joystick or push button control. The centering option is not available with this configuration. In this configuration, the crane head and magnetic claw may be moved in one direction (for example, forward) to the desired position. When movement forward is stopped, movement in that particular direction is locked. The crane head and the magnetic claw may then be moved in another direction (for example, to the right in FIG. 1). When movement to the right is stopped, the claw will automatically drop. Likewise, right motion may be initiated first, followed only be forward movement.

The B game configuration is also known as the "Dragger Game." In this configuration, the joystick gives full selection of position on the playing field. Operation of the red joystick button permits dropping of the magnetic claw in small increments. Re-aiming of the claw is permitted after dropping is initiated.

The B+ game provides the joystick with full selection of position on the playing field. Operation of the red joystick button initiates automatic dropping of the magnetic claw. Dropping of the claw in small increments is not permitted and re-aiming of the claw is not permitted after dropping is initiated.

The C game gives the joystick full selection of position on the playing field. Operation of the red joystick button permits dropping of the claw in small increments.

This configuration is similar to the B game, except that re-aiming of the claw is not permitted after dropping of the claw is initiated.

Regardless of the game selected, if the player successfully grabs a prize 16 with the claw 24 within the allotted time T, the claw returns home, deposits the prize 16 in the prize box 30 and control is immediately returned to the player. Play continues until the full round time T has expired. Thus, the player can win more than one prize 16 per playing round.

The game routine implements game play functions. The crane is generally controlled by player inputs. Upon claw activation, the crane head 22 moves to the home position, releases the claw 24, and goes to the post game sub routine.

If time remains, game play continues. If the allotted time has expired, the post game sub routine performs various accounting functions and the machine returns to the attract mode. FIG. 4 also discloses the timer interrupt routine. The timer interrupt routine includes various modules including display control, meters and rope lights, switch reading and debouncing, coin routine, and timers for motors, sound, and general purpose use.

The software setting set up also provides a warning alert or alarm period that begins a predetermined time TL before the expiration of the round playing time T. The time T=TL+TW. For example, TL may be set to 15 or 20 so that the warning period begins at TW, which is calculated to be 15 or 20 seconds prior to the expiration of time T. Audio and/or visual signals indicate to the player that the playing time is almost over and prompt the player to insert additional coins for added time. If the player inserts additional coins before the expiration of time T, the round playing time T and other associated variables are recalculated accordingly.

To the benefit of the player, the crane head 22 does not return home unless a plunge for a prize 16 is made or the time T for the playing round expires. The crane head 22 will stay in close proximity to the prize 16 sought while additional coins are inserted. Thus, the player does not have to reposition the head 22 from the home position and start anew, as in a conventional single play, single pay game round. The average cost to an individual player per prize won by may be less. The average cost per second of play can sometimes be lower as well.

The multiple play, multiple win method of this invention is made possible by "burning" a program into an electrically erasable programmable read only memory (EEPROM) chip. The basic chip is available from ATMEL under the designation AT89C55-24JC. The chip is an eight bit 20K flash programmable microcontroller. The chip is installed in the main controller board of the machine.

Standard programming techniques and language are utilized to convert the logic of the flow chart in FIG. 4 into the necessary source code. Preferably the program runs based upon units of time rather than credits. A copy of the source code listing is attached as Appendix A. The following comments apply to the source code.

The coin routine reads coin switches and DBA output, debounces them and accumulates the credit information. When enough credit is available the coin route exchanges the credit for time and sets ICRFLG (Initial Coinage Received Flag). Then additional time can be purchased at the additional coinage rate. For example, normal set up would sell 20 seconds of play time for the first 2 coins (50¢), then sell 15 seconds of play time for each additional coin (25¢)coinage and hence time may be added even during game play. Game play, and hence the count downs of the play timer, does not start until the joystick 20 is moved. The ICRFLG is reset when time is 0:00.0.

Time count down and display is performed in the timer interrupt subroutine. When time is <15 seconds and >0 seconds, the TOSF (Time Out Sound Flag) is set. This flag causes the display to flash and the time out sound to be output. The time out sound is a loud chirp that increases in pulse count per half second as the time decreases to zero. The idea is to generate an increasing excitement and urgency as the time runs out, and to incite the player to purchase more time. Play continues until time runs out. As long as time remains, the player has immediate control of the joystick 20 after the claw 24 opens in the home position.

Figure 5:
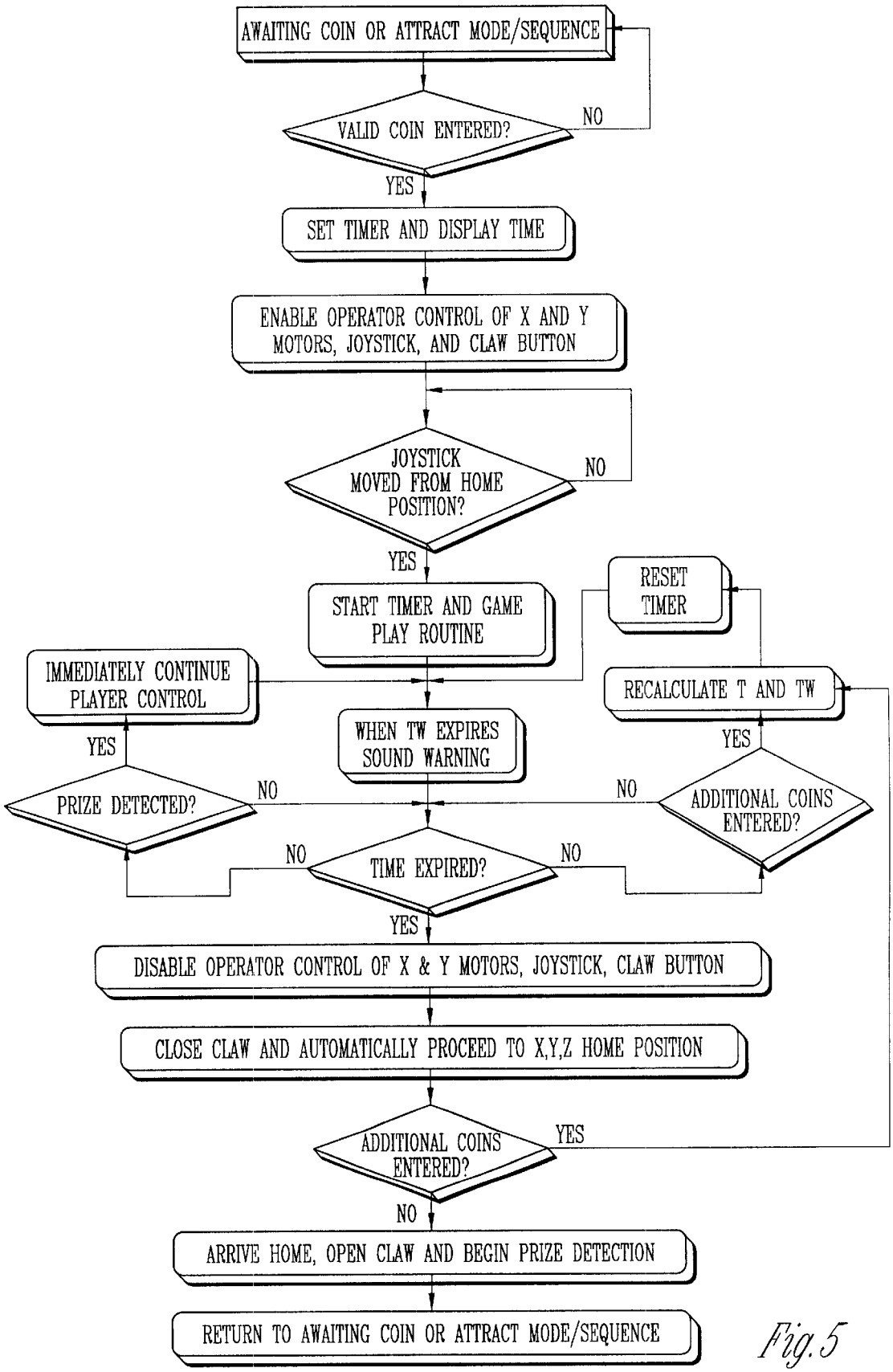
FIG. 5 is another flow chart further illustrating the method of this invention.

FIG. 5 summarizes the logic of the computer program and thereby further illustrates the method of this invention. One important thing to notice in FIG. 5 is that new coin entries are accepted to extend playing time in the round up until the time the crane head 22 finally arrives at the home position after the previously purchased playing time has expired.

From the foregoing, it can be seen that the present invention at least achieves the stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the claimed invention.

What is claimed is:

1. A method of extending playing time per round in a coin-operated crane game, comprising the steps of:

providing a crane game machine including a crane movable from a home position to capture prizes contained in the machine, a timer, and a coin slot electrically connected to the timer;

detecting a valid coin entry into the coin slot of the machine;

providing an initial allotted playing time for a playing round according to a first predetermined ratio of seconds of playing time per coin;

starting the timer when the crane is moved from its home position; continuing to detect valid coin entries after the timer starts;

calculating a revised allotted playing time per round equal to the initial time plus any additional time purchased according to a second predetermined ratio of seconds of playing time per coin whenever additional coins are entered into the coin slot;

maintaining the movement of the crane under player control except when a prize has been captured and the crane is returned to the home position to deposit the prize in a player-accessible prize box; and returning movement of the crane to player control after the crane deposits the prize in the prize box so long as the revised allotted playing time has not expired;

whereby player can extend the revised allotted playing time per round by entering additional coins and can win more than one prize during the round.

2. The method of claim 1 wherein the first predetermined ratio of seconds of playing time per coin is greater than the second predetermined ratio of seconds of playing time per coin.

3. The method of claim 1 comprising generating an alerting signal to the player when a predetermined amount of time remains in the round.

4. The method of claim 3 wherein the alerting signal includes a chirp that is audible to a human being and has a pulse count per second that increases as the initial allotted playing time left remaining in the round decreases.

5. The method of claim 3 wherein the alerting signal includes a chirp that is audible to a human being and has a pulse count per second that increases as the revised allotted playing time left remaining in the round decreases.

6. The method of claim 3 wherein the step of generating an alerting signal includes flashing a set of digital readout timer lights on the machine.

7. The method of claim 1 comprising:

providing the crane game machine with an attract mode in which humanly perceivable audio signals are generated to attract potential players;

ceasing the attract mode once a valid coin entry has been detected at the coin slot; and resuming the attract mode once the round has expired.

8. A method of extending playing time per round in a coin-operated crane game, comprising the steps of:

providing a crane game machine including a crane movable from a home position to capture prizes contained in the machine, a timer, and a coin slot electrically connected to the timer;

detecting a valid coin entry into the coin slot of the machine;

providing an initial allotted playing time for a playing round according to a first predetermined ratio of seconds of playing time per coin;

starting timer when the crane is moved from its home position;

continuing to detect valid coin entries after the time starts;

calculating a revised allotted playing time per round equal to the initial time plus any additional time purchased according to a second predetermined ratio of seconds of playing time per coin whenever additional coins are entered into the coin slot;

sensing whether a prize has been captured by the crane;

returning the crane to player control if a prize has not been captured and the revised allotted playing time has not expired;

maintaining the movement of the crane under player control except when a prize has been captured and the crane is returned to the home position to deposit the prize in a player-accessible prize box; and returning movement of the crane to player control after the crane deposits the prize in the prize box so long as the revised allotted playing time has not expired.

* * * * *